United States Patent [19]

Nezworski

[11] Patent Number: 4,805,649

[45] Date of Patent: Feb. 21, 1989

[54] BEVERAGE GLASS WASHER

[75] Inventor: James E. Nezworski, Waukesha, Wis.

[73] Assignee: Perlick Corporation, Milwaukee, Wis.

[21] Appl. No.: 117,155

[22] Filed: Oct. 30, 1987

[51] Int. Cl.[4] ..... B08B 3/02

[52] U.S. Cl. ..... 134/57 R; 134/72; 134/107; 134/108; 134/111; 219/314

[58] Field of Search ..... 134/57 R, 57 D, 68, 134/72, 107, 108, 111; 68/205 R, 207; 219/314, 325, 326, 328

[56] References Cited

U.S. PATENT DOCUMENTS

| | | | |
|---|---|---|---|
| 2,949,120 | 8/1960 | Federighi et al. | 134/72 X |
| 3,484,580 | 12/1969 | Morgan | 219/314 |
| 3,724,418 | 4/1973 | McLain | 134/108 X |
| 4,076,554 | 2/1978 | Weihe | 134/72 X |
| 4,313,451 | 2/1982 | Vilen | 134/72 X |

FOREIGN PATENT DOCUMENTS

| | | | |
|---|---|---|---|
| 863301 | 3/1961 | United Kingdom | 134/57 D |

*Primary Examiner*—Philip R. Coe

*Attorney, Agent, or Firm*—James E. Nilles; James R. Custin

[57] ABSTRACT

In the glass washer of this invention, a linear conveyor carries glasses successively through a prewash, a detergent wash and a germicidal rinse. Once discharged from rinsing nozzles, rinsing liquid is collected in a prewash tank from which it is pumped exclusively to other nozzles that provide the prewash. Detergent solution discharged from washing nozzles is collected in a wash tank and recycled back to the washing nozzles. Hot water and detergent chemical are fed into the wash tank at predetermined rates whenever the machine operates, to provide a makeup detergent solution and some overflow from the wash tank to the prewash tank. Novel screening means ensure against entry of foreign matter into the nozzles. Novel control means cause the machine to operate with its conveyor almost always fully loaded, for economical utilization of water, chemicals and current.

20 Claims, 6 Drawing Sheets

BEVERAGE GLASS WASHER

FIELD OF THE INVENTION

This invention relates to apparatus for washing beverage glasses and is more particularly concerned with an improved glass washer for taverns and restaurants that requires minimal service and maintenance and is economical in its consumption of water, cleaning chemicals and electric current but is nevertheless reliable in affording total sanitization of washed glasses.

BACKGROUND OF THE INVENTION

A number of beverage glass washers have heretofore been commercially available, and patent literature contains proposals for many more; but all such prior art machines suffer from one or more of a number of important deficiencies, notwithstanding that the art relating to such machines is relatively old and well developed and the public health implications of beverage glass sanitization are well understood and widely appreciated.

A basic requirement for a glass washer is absolute reliability. A busy restaurant or tavern cannot practicably have enough beverage glasses to operate through a full day without washing at least some of them. Mechanical failure of the glass washer therefore puts the establishment out of business until the machine is back in operation, because there is almost never a backup for the glass washing machine, especially in the many jurisdictions where manual washing of beverage glasses is prohibited.

A more serious problem arises when the machine continues to run but does not effect complete sanitization of the glasses passed through it. The term "sanitization" is used herein to denote both cleaning and sterilization. Thus an adequate sanitization process must include a wash with a detergent solution at a temperature of at least 120° F., for removal of soil such as lipstick, followed by a rinse with a germicidal solution of chlorine, iodine or the like. Applicable laws and regulations require these solutions to have prescribed minimum concentrations of the respective chemicals.

Most prior glass washing machines have been designed for reliance upon a daily check of the detergent and germicide reservoirs to ensure that these requirements will be met. Because such a check may be neglected or carelessly performed, some machines have lamps or the like that signal the need for replenishing the chemical supplies, but observations of such machines under actual operating conditions have revealed that their signals are sometimes unnoticed or disregarded for hours or even days at a time, thus subjecting the public to serious health hazards. In the light of this unexpected finding, the present invention is in part based upon an appreciation of the heretofore unrecognized requirement that a glass washing machine should in some manner impose upon its operator an absolute requirement for maintaining an adequate supply of detergent and germicide in its chemical reservoirs, and that the most effective way to accomplish this is to cause the machine to stop when a chemical is not being fed at an adequate rate.

To this end, solution concentration can be monitored by means of a pair of electrodes immersed in the solution, for measuring its electrical conductivity or resistance. The reliability of such a detector is dependent upon the water and chemicals used in the washing process and also to some extent upon the types of beverages served in the glasses to be washed. Certain substances present in the water or chemicals can cause deposits on the electrodes that result in false outputs. Salt or fruit acids in the washing liquid, introduced from glasses that have been used for margaritas or the like, can materially change in the conductivity of the liquid and can likewise cause false indications. The present invention therefore provides a more reliable means for monitoring solution concentration and causing the machine to stop when a chemical supply needs to be replenished.

Provision of adequate hot water involves a complex of problems. Some prior glass washers had no provision for heating incoming water. They were intended to be connected with an external hot water source, but all too often the hot water capacity of that source was insufficient, and at times, therefore, such glass washers operated with water too cool to ensure complete sanitization. On the other hand, a water heater built into the machine must be capable of bringing a large volume of water quickly up to a required temperature and must nevertheless operate with the lowest possible current consumption. Water heating economy is dependent not only upon the efficiency of the heating equipment itself but also upon the manner in which the machine is operated as well as upon its recirculation scheme.

For high volume glass sanitization, a glass washing machine should be so arranged that dirty glasses can be loaded into it and clean glasses can be unloaded from it while it is operating. Most prior machines that meet this requirement had a linear conveyor with a loading end onto which dirty glasses were placed and an unloading end from which clean glasses were removed and were designed on the assumption that the machine would be turned off when not needed. That assumption has been found to be incorrect. In a test, such a glass washer, installed in a busy restaurant, was equipped with suitable metering devices and, under typical conditions, was found to have been left running continuously for eight hours, during which it was actually washing glasses through a total of only two hours. This meant that during 75 per cent of its eight hour running time, water, chemicals and current were being wasted at substantial cost. With this in mind, the present invention provides a control mechanism for a continuous-process glass washer whereby the machine is allowed to operate only when it can operate usefully.

An important consideration in this respect is that the machine should not ordinarily be allowed to operate when only a few glasses have been loaded into it. About as much water, chemicals and current are needed for cleansing one glass as for a full capacity load of glasses. Thus another problem solved by the invention is that of providing for so controlling the machine that it operates only when and as it is loaded for operation at maximum efficiency.

The prior art discloses several kinds of glass sanitization cycles wherein sanitizing liquids are recirculated in the machine for conservation of water, heat and chemicals. One might suppose that design of an optimum sanitizing cycle and recirculation scheme would involve little more than selection from among a relatively limited number of combinations and permutations; but in fact the prior art demonstrates that the problem does not have such an obvious solution because no completely satisfactory arrangement has heretofore been devised. U.S. Pat. No. 3,094,997, to Nolte et al, disclosed a washer having one wash stage in which wash water was recirculated and one rinse stage wherein the rinse water was (depending upon the operator's choice) drained and thus wasted or delivered into the tank from which wash water was recirculated, to thus dilute the wash water detergent concentration. U.S. Pat. No. 3,731,696, to Hackney, discloses a glass washer having washing, first rinse and final rinse stages, wherein the liquid used for each stage was recirculated for exclusive use within that stage. From a sanitary standpoint the arrangement was perhaps suitable for the small batch-type washer in which it was disclosed, but it would not have been satisfactory for a continuous-process washer. Somewhat superior in this respect was the substantially earlier U.S. Pat. No. 1,681,839, to Breton, disclosing a plural stage washer wherein liquid from each stage was recirculated back to a preceding stage to move progressively from the cleanest to the dirtiest glasses; but here the washing liquid would be subjected to constant dilution of its detergent content. Since the germicidal rinse liquid can be substantially cooler than the detergent solution, this arrangement was also wasteful of water heating energy. A more recent arrangement, disclosed in U.S. Pat. No. 3,878,856, to Hall, has some advantages over those discussed above in that the washer has a washing stage wherein washing liquid is recirculated, followed by first and final rinse stages, the rinsing liquid used in the final rinse stage being in part recirculated in that stage and in part delivered back to the first rinse stage, where it is discharged to drain immediately after use. Recirculation of the final rinse liquid cannot be considered altogether objectionable in view of the fact that final rinse follows a first rinse, but one can question the logic of recirculating final rinse liquid in the face of the fact that liquid that has been used for the less critical first rinse is not recirculated.

The prior art, which is merely exemplified by the above discussed patents, teaches that the sequence of sanitizing stages and the recirculation scheme are interrelated and have a direct bearing on economy of operation and attainment of complete sanitization, but it does not teach the arrangement that is optimum in these respects, particularly for a continuous-process machine. Furthermore, the present invention is in part based upon recognition that the recirculation scheme also has a relationship to dependable operation of the washer, to maintenance of a constant inflow of makeup water that prevents excessive contamination of recirculated liquid, and to accurate maintenance of required detergent and germicide concentrations in the respective washing and rinsing liquids.

A problem which is intimately related to the recirculation scheme, and which has a direct bearing upon reliability of operation as well as upon economy of operation, is that of nozzle plugging.

In most washers, glasses are cleaned by subjecting them to spray or jets from numerous nozzles, each of which has a relatively small discharge outlet that is easily blocked by a bit of foreign matter. Glasses loaded into the washer often contain particles of fruit pulp, small berry seeds, or even paper napkins or cigarette butts, and such materials must obviously be prevented from being carried into the nozzles by recirculated liquid.

Of course screens have been incorporated in the recirculation systems of prior washers, but such screens have not been arranged to provide total insurance against nozzle blockage. In most cases the screen had to be removed for cleaning and its removal often permitted bits of material that had accumulated in the recirculation system upstream from the screen to pass the screen location and enter the duct leading to a set of nozzles, giving rise to the blockage that the screen was intended to prevent.

The screens in most prior recirculation systems were so arranged that foreign matter continued to accumulate on them until they were cleaned. Such an accumulation could reach a point where the screen was substantially blocked. Either a blocked screen or a blocked nozzle will cause a reduction in the amount of recirculating liquid being discharged against glasses and can thus be responsible for incomplete sanitization. However, most prior machines had no means for signaling that a screen needed cleaning or that a nozzle was blocked, and often the known blockage of one or a few nozzles was ignored because of the cost or inconvenience of remedying the condition. With this in mind, the present invention proceeds from a recognition that a glass washing machine should be caused to stop operating whenever an insufficient flow of any cleansing liquid is being discharged against glasses to be cleaned.

SUMMARY OF THE INVENTION

The general object of this invention is to provide a continuous-process glass washing machine for taverns and restaurants that operates reliably with a minimum of maintenance, ensures total sanitization of glassware, and nevertheless operates at low cost for water, chemicals and electric current.

In this connection it is an object of the invention to provide a continuous process glass washing machine which can clean substantially more glasses in a given time period than a batch process machine occupying an equivalent space, to be capable of providing clean glasses when and as they are needed, but which nevertheless operates more economically than batch process machines.

An important object of the invention is to provide a glass washer with which complete sanitization of glassware is assured and cannot be defeated by negligence or by improper measures intended to reduce operating costs, in that the machine has reliable means for maintaining correct chemical concentrations in washing and rinsing liquids and has tamper-resistant means for causing the machine to shut down when a chemical supply needs to be replenished.

A further object of the invention is to provide a glass washing machine that has a novel and significantly improved cleaning sequence and recirculation scheme which not only ensures total sanitization of glassware passed through the machine but also ensures optimum economy with respect to consumption of water, chemicals and electric current.

Another and more specific object of the invention is to provide a glass washing machine wherein a portion of a liquid used in the cleaning process is recirculated through fine-mesh screen means for filtering out of that liquid any material in it that might cause nozzle blockage, said screen means being so arranged as to be self-cleaning to a substantial extent and to be readily cleaned without danger of foreign matter being introduced into the spray nozzle duct.

A further object of the invention is to provide a glass washing machine having a recirculation system wherein there is a screen that achieves the last mentioned object of the invention and wherein simple, reliable and effective means are provided for shutting down the machine when the screen is blocked to such an extent that recirculation is significantly impeded.

Another specific object of the invention is to provide a continuous-process glass washing machine in which glasses to be washed are carried along a defined path from a loading station to an unloading station, which automatically shuts itself off when cleaned glasses are available at its loading station, and which must be manually restarted whenever dirty glasses are loaded into its loading station, to ensure that it will operate only when and as it is needed and thus will not waste water, chemicals or electric current.

Another specific object of the invention, which can be realized either along with the last stated object or independently of it, is to provide for intermittent operation of the machine in such a manner as to ensure that the portions of the machine in which sanitizing liquids are discharged will be substantially completely filled with glasses whenever the machine is in operation, to thus achieve the most economical utilization of the sanitizing liquids.

It is also a specific object of the invention to provide a glass washing machine that has built-in means for electrically heating the water that it uses, so arranged as to ensure fast heating of water to the required temperature, thus minimizing start-up delay, but providing for efficient heat transfer and heat utilization to ensure economical current consumption.

Bearing in mind that washed glasses cannot be routinely checked for cleanliness and germ-free sterility, the ultimate object of this invention is to eliminate a serious and virtually undetectable public health hazard by providing a glass washing machine which operates in such a manner as to ensure that every glass washed by it will be clean and germ-free, which will not operate at all unless and until it is in a condition to achieve that result, and which nevertheless operates very economically and can be easily maintained in a condition that ensures its consistent and reliable operation.

BRIEF DESCRIPTION OF DRAWINGS

In the accompanying drawings, which illustrate what is now regarded as preferred embodiments of the invention.

DETAILED DESCRIPTION OF PREFERRED EMBODIMENTS OF THE INVENTION

Cleaning Sequence and Recirculation Scheme

Figure 1:
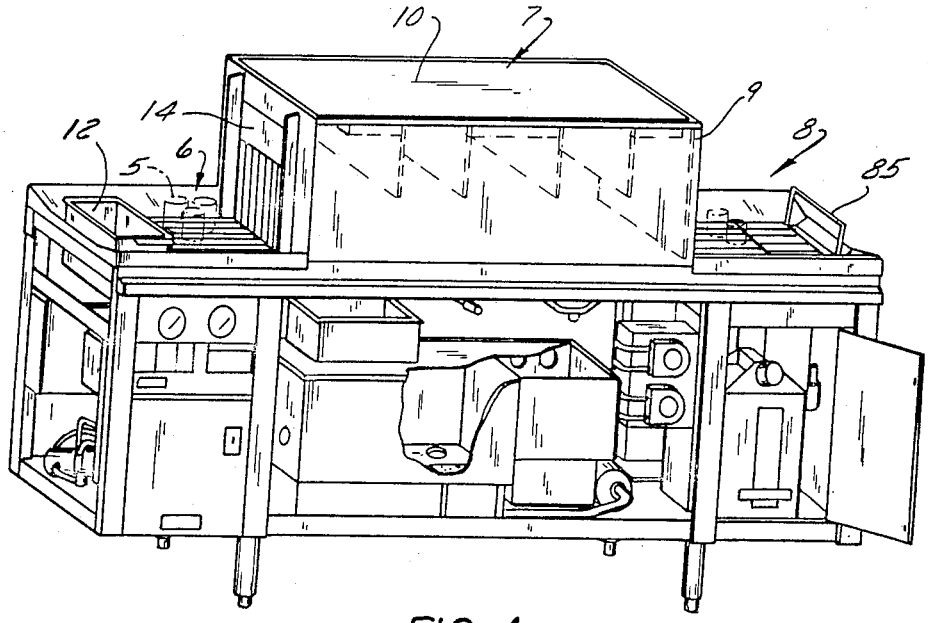
FIG. 1 is a side perspective view of a machine embodying this invention, with portions shown broken away.

The machine of this invention comprises a conveyor 5 upon which glasses to be washed are carried upside down from a loading station 6 defined by one end portion of the conveyor, through successive cleansing zones in a tunnel 7, to an unloading station 8 defined by an opposite end portion of the conveyor. The conveyor 5 is in this case a linear one that carries the glasses along a straight path, but as the description proceeds it will be apparent that the principles of the invention could as well be embodied in a machine having a rotary conveyor on which the glasses move in an arcuate path.

The tunnel 7 in which all cleansing takes place simply comprises a pair of upright side walls 9 and a top wall 10. The top wall can be overlain by a fibrous mat (not shown) to serve as a drainboard to which glasses can be transferred from the unloading station 8 and on which they can dry.

It is advantageous to provide the machine with a small open-topped trash container 12 near the loading station 6, into which drinking straws and the like can be conveniently emptied out of the glasses before they are placed on the conveyor.

Glasses on the conveyor 5 enter the tunnel 7 through a vertically slitted curtain 14 which allows the glasses to pass but blocks passage of cleansing liquids that are discharged from spray nozzles N inside the tunnel. There is a similar curtain 15 at the outlet end of the tunnel.

In the tunnel 7 the glasses pass through three successive cleansing zones, for each of which there is a set of spray nozzles N1, N2, N3. Some of the nozzles of each set are mounted close to the top wall 10 of the tunnel for downward discharge to clean exterior surfaces of the glasses, and the rest are mounted below the conveyor 5 for upward discharge through it into the interiors of the glasses.

In the first cleansing zone the glasses are subjected to a prewash with liquid that has been previously used as described hereinafter, discharged from a set of prewash nozzles N1. This prewash removes at least the major portion of solid and semisolid material that tends to cling to the glasses, such as berry seed and bits of fruit pulp. All of the liquid discharged from the prewash nozzles N1 is collected and conducted directly to a waste drain D, without reuse, taking with it most of the foreign matter that could cause blockages if such liquid were recirculated.

In the second cleansing zone, which is separated from the first by a pair of slitted curtains **16*a*, a hot detergent solution is discharged against the glasses from a set of washing nozzles N2, for removal of soil such as lipstick. For economy, a major portion of the liquid discharged from the washing nozzles N2 is recirculated back to those nozzles, along with a minor portion of fresh makeup detergent solution. For such recirculation all liquid discharged from the washing nozzles is collected and directed into a screening vessel 17, the bottom portion of which is made of fine mesh screen material such as perforated stainless steel. The detergent solution entering the screening vessel 17 normally falls through its bottom portion into a retention tank 18 from which it is recirculated back to the washing nozzles N2 by means of a wash pump 19**, preferably of the centrifugal type.

The apertures in the screen portion of the screening vessel 17 are of smaller diameter than the outlets of the nozzles N2, so that the screening vessel retains any particles that might block the washing nozzles, a 40-mesh screen being suitable in this respect. If the screen portion of the screening vessel 17 becomes blocked to such an extent that liquid enters that vessel faster than it can fall through it into the retention tank 18, overflow from the screening vessel takes place at an overflow outlet 20 which is defined by a notch in its upper edge. Overflow liquid from the screening vessel 17 can be guided either directly to the drain D that conducts liquids away from the machine or into a second retention tank 22 that is described hereinafter.

Whenever the machine is in operation, fresh water and detergent chemical are fed directly into the washing liquid retention tank 18, as explained below, to provide makeup detergent solution at a rate preferably equal to about 5% of the rate at which the solution is discharged from the washing liquid nozzles N2. Since all of the washing liquid drawn from the retention tank 18 and discharged from the washing nozzles N2 is returned to that tank, the addition of makeup liquid causes an overflow from time to time from the tank 18 to the second retention tank 22, as explained hereinafter. There is thus a constant renewal of the detergent solution in the tank 18 that prevents it from becoming excessively soiled. Note that the wash pump 19 has its inlet connected only with the retention tank 18 and its outlet connected only with the washing nozzles N2 so that only detergent solution, unmixed with any other liquid, is delivered to the washing nozzles.

In the third cleansing zone, which is separated from the washing zone by another pair of slitted curtains **16*b*, the glasses are subjected to a spray of germicidal rinsing liquid discharged from a set of rinsing nozzles N3. Only fresh rinsing liquid, produced as described below, is delivered to the rinsing nozzles N3. However, all of the liquid discharged from the rinsing nozzles is directed into the second or prewash liquid retention tank 22** for eventual delivery to the prewash nozzles N1.

A prewash pump 23, preferably of the centrifugal type, has its inlet connected exclusively with the prewash liquid tank 22 and its outlet connected exclusively with the prewash nozzles N1.

CONVEYOR

The conveyor 5 is of a well known type that comprises a set of laterally spaced, longitudinally extending fixed slats 24 and a set of movable slats 25 that alternate with the fixed slats across its width. All of the slats are strip-like and edgewise upright, to be relatively slender in the direction widthwise of the conveyor, and the distances between laterally adjacent slats, which are preferably uniform across the conveyor, are great enough to permit glasses on the conveyor to be sprayed with liquid from the nozzles beneath it.

Laterally extending narrow beams 26, fixed to the frame F of the machine, support the fixed slats 24 with their top surfaces in a common horizontal plane. The movable slats 25, which likewise have coplanar top surfaces, are mounted on a conveyor frame (not shown) that is actuated for bodily cyclical motion by a suitable mechanism (not shown) driven from an electric motor 29. Such actuation raises the movable slats 25 to bring their top surfaces above the top surfaces of the fixed ones while moving them lengthwise forwardly, then lowers the movable slats and moves them lengthwise rearward. Glasses on the conveyor are supported on the fixed slats 24 while the movable slats 25 are in the lowered, rearwardly moving portion of their cycle, and they are supported on the movable slats 25 as the latter rise and move forwardly during the other part of their cycle, to be thus advanced in increments.

If the conveyor were permitted to operate continuously, it would carry a glass from the loading station 6 to the unloading station 7 in a period of, for example, 3½ to 4 minutes. For operating economy, however, as explained hereinafter, the machine normally shuts down after a predetermined period of operation following each start, which period is long enough (e.g. 45 seconds) to carry glasses from the loading station into the tunnel.

Discharged Liquid Collection Means

Figure 6:
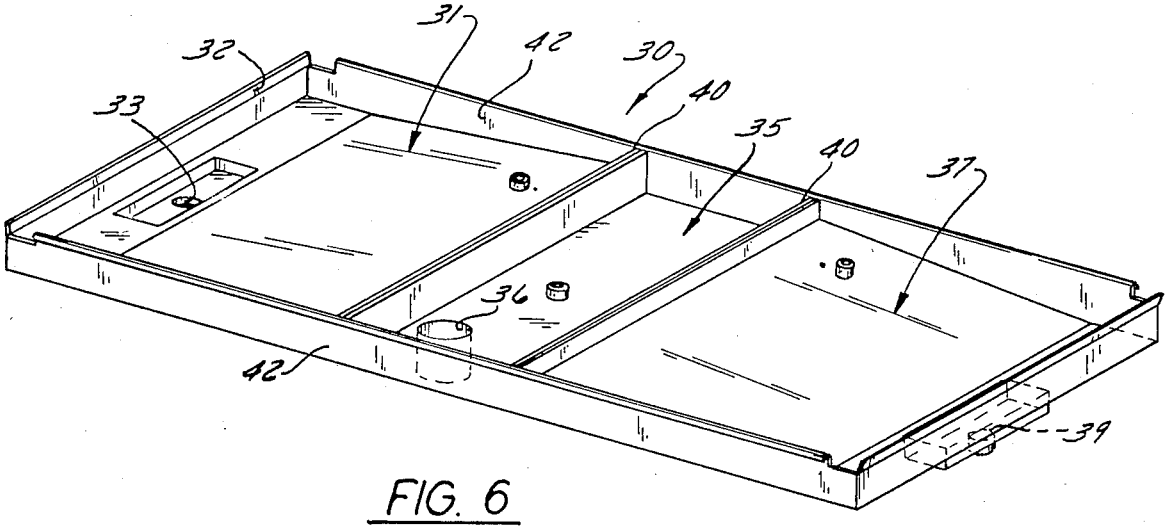
FIG. 6 (on the sheet with FIG. 1) is a perspective view of the collection pan for collecting liquids discharged from the several nozzles.
Figure 2:
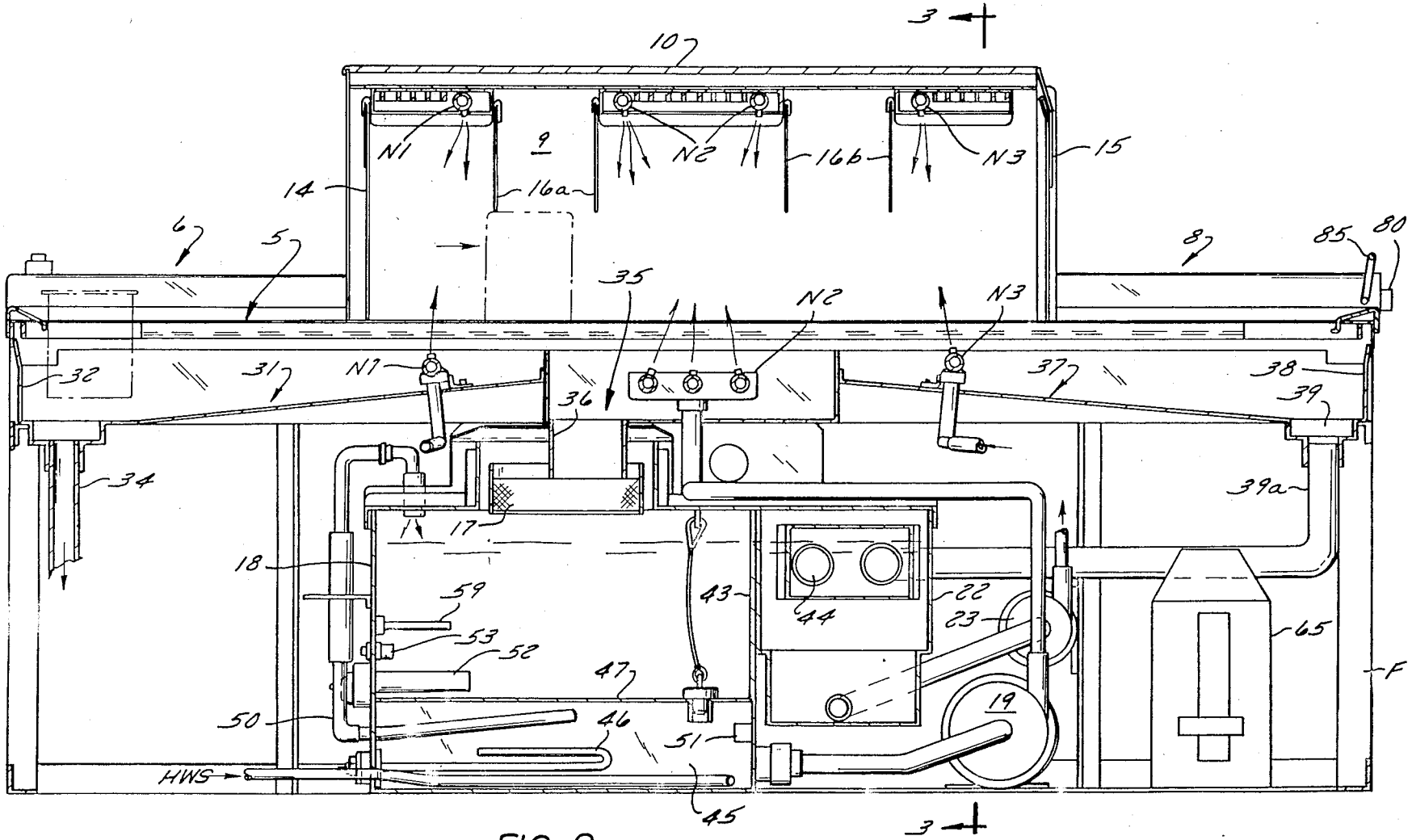
FIG. 2 is a view of the machine in longitudinal section, taken on a vertical plane.
Figure 3:
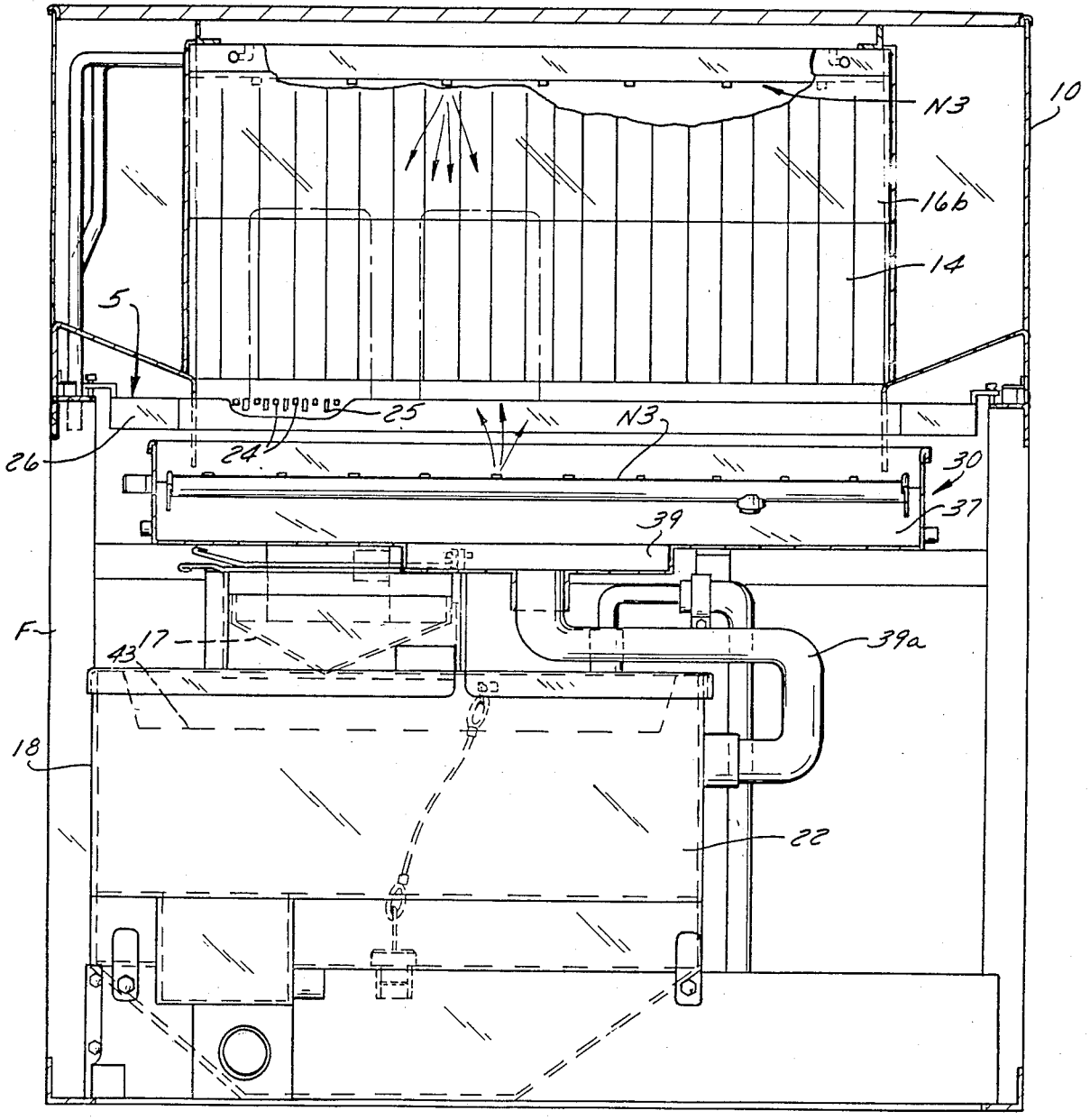
FIG. 3 is a view in transverse section, taken on the plane of the line 3—3 in FIG. 2.
Figure 4:
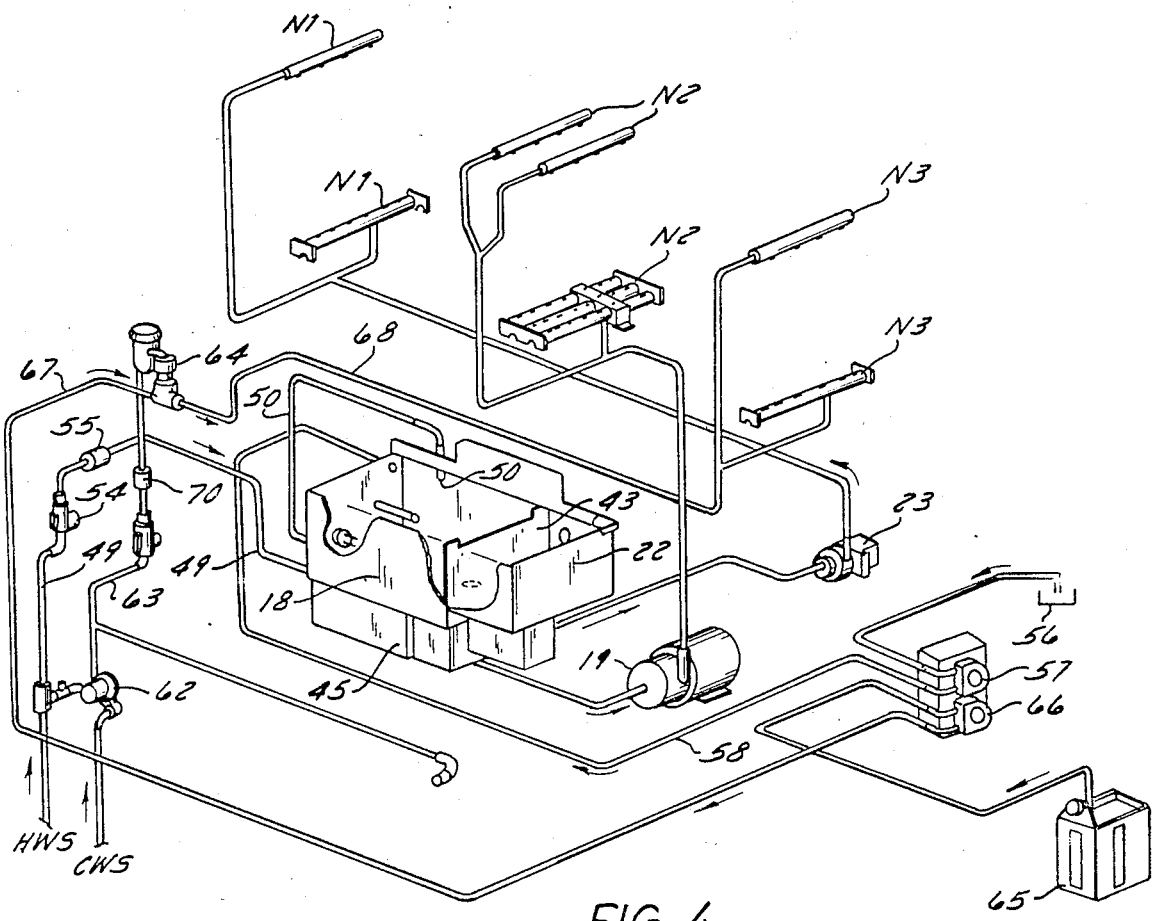
FIG. 4 is a diagrammatic perspective view of the liquid flow systems in the machine of this invention.
Figure 5:
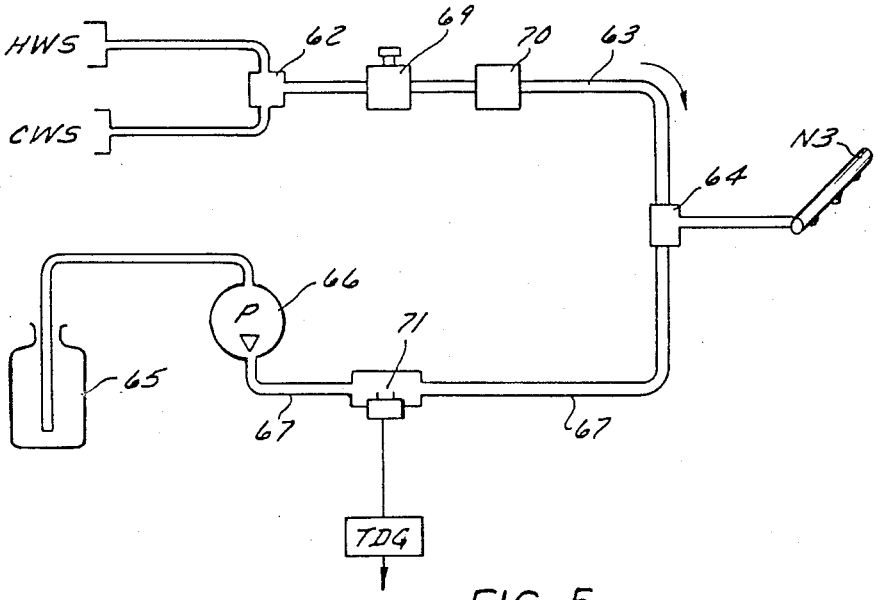
FIG. 5 is a diagram of a preferred arrangement for preparing germicidal rinse solution and monitoring the solution concentration thereof.

For collecting the liquids discharged from the several sets of nozzles N1–N3, there is a shelf-like collection pan 30 (FIG. 6) that is mounted below the lower nozzles of the several nozzle sets and above the screening vessel 17. This pan 30 has three portions, each of which extends across the entire width of the machine.

The first portion 31 of the collection pan 30, which underlies the prewash zone, is inclined downwardly and towards the loading station all along its length. At its low end it terminates at an upright laterally extending wall 32 and has an outlet 33 to which a duct 34 is connected that leads downwardly to the waste drain D. This first portion 31 thus serves to collect all of the liquid discharged from the prewash nozzles N1 and direct it to drain through the drain duct 34.

The second or middle portion 35 of the collection pan underlies the wash zone to collect detergent solution discharged from the washing nozzles N2. It has an outlet 36 that opens downward into the screening vessel 17.

The third portion 37 of the collection pan 30 underlies the rinsing zone and serves to collect liquid discharged from the rinsing nozzles N3. It slopes downward and towards the unloading station, and at its low end it has a laterally extending upright wall 38 and an outlet 39. A duct **39*a* is connected to the outlet 39 to receive rinsing liquid and discharge it into the prewash liquid retention tank 22**.

At each end of the middle portion 35 of the collection pan 30 there is an upright stub wall 40 which extends entirely across the width of that pan and projects above the high ends of its first portion 31 and its third portion 37. These stub walls 40 cooperate with the respective slitted curtains **16*a* and 16*b* to prevent prewash and rinsing liquids, discharged from the respective nozzle sets N1 and N3, from entering the washing liquid recirculation system. In addition, the top wall 10 of the tunnel 7 is underlain by egg-crate-type grids 41 that cause liquid discharged upwardly from the lower nozzles of each set to drip straight down into its assigned portion of the collection pan 30. It will be understood that the collection pan 30 has upright side walls 42 which extend along its full length and to which the transverse walls 32, 38 and 40** are connected.

Washing Liquid Recirculation and Makeup System

The two retention tanks 18 and 22 are disposed side-by-side at a level below the collection pan 30. They preferably have a wall 43 in common that serves as a weir across which detergent solution can overflow out of the washing liquid tank 18 and into the prewash liquid tank 22. The level of the top edge of the weir 43 is thus the highest level to which detergent solution can rise in the washing liquid tank, so that used detergent solution can be discarded by way of the prewash tank, in which it is mixed with used rinsing liquid for delivery to the prewash nozzles.

The prewash liquid retention tank 22 has an overflow outlet 44 which is communicated directly to the waste drain D and which is at a level below the top of the weir 43 so that there can be no flow from the prewash liquid tank 22 into the washing liquid tank 18, thus ensuring that the hot detergent solution will not be diluted with cooler rinsing liquid. Obviously, overflow of screened detergent solution into the prewash liquid tank 22 is not undesirably because liquid in that tank is used only for prewash and is discarded without recirculation after its discharge from the prewash nozzles N1.

To provide an adequate supply of hot water for detergent solution there is a water heating tank 45 directly under the washing liquid tank 18, in which there is a high capacity (e.g., 3,000W) immersion-type electric water heater 46. The bottom wall 47 of the washing liquid tank 18 also serves as the top wall of the heating tank 45, and normally the latter is completely filled with water so that the contents of those two tanks 18 and 45 are in heat exchange relationship through that common wall. The heating tank 45 is filled by means of ducting 49 connected with a water source HWS, preferably a source of water that has been preheated to some extent. Such external preheating is desirably for optimum heat energy economy and to allow for fast start-up of the machine at the beginning of the business day. A makeup water duct 50, connected to an outlet in the heating tank 45, conducts heated water out of that tank and debouches it downwardly into the washing liquid tank 18.

The heater 46 in the heating tank 45 provides most of the heat energy needed to maintain detergent solution at the required minimum temperature. Its energization is controlled by a thermostatic switch 51 in the heating tank whereby the temperature of water in that tank is maintained in the range of 120°-140° F.

The heating tank 45 is of substantially smaller capacity than the washing liquid tank 18 above it, and because of the heat exchange between those tanks through the wall 47, the heater 46 tends to maintain the detergent solution in the tank 18 at the required temperature. However, to ensure that the machine will always operate with hot enough detergent solution there is a smaller capacity (e.g., 1200W) electric immersion heater 52 in the retention tank 18, controlled by a thermostatic switch 53 in that tank. This last mentioned thermostatic switch 53 could also be connected into the circuitry that controls the moving parts of the machine, such as the pump motors and conveyor drive, in an arrangement (explained hereinafter) that prevents the machine from operating when detergent solution in the tank 18 is below the required minimum temperature.

A solenoid valve 54 in the ducting 49 that connects the heating tank inlet with the water source HWS provides for shutting off flow of water to the heating tank 45 when the machine is not in operation. Because water enters the heating tank 45 near its bottom and the outlet to the makeup water duct 50 is near its top, that tank is normally completely filled, and makeup water is delivered to the washing liquid tank 18 from the supply system whenever the solenoid valve 54 is open. Preferably there is a flow control valve 55, such as a sphincter valve, at some point along the ducting 49, 50 that leads from the water source HWS to the tank 18, to constrain makeup water to enter that tank at a predetermined constant flow rate notwithstanding variations in supply system pressure.

Detergent chemical is fed from a reservoir 56 to the detergent solution tank 18 by means of a constant volume pump 57, such as a peristalsis pump, which delivers the chemical through a duct 58 that debouches downwardly into that tank. As here shown, a sensor 59 in the tank 18 detects the concentration of the detergent solution on the basis of its electrical conductivity and is connected to control operation of the detergent pump 57, turning it on and off as necessary to maintain detergent concentration at a constant predetermined value. Instead of employing the sensor 59, the detergent pump 57 can be controlled to operate whenever the solenoid valve 54 is open; and with both water and detergent chemical fed at constant rates, a constant detergent concentration will thus be maintained. The solution concentration sensor 59 is here shown and described by way of example. A preferred sensor arrangement is described hereinafter in connection with the germicidal rinse system.

Because water and detergent chemical are debouched downwardly into the washing liquid tank 18, and there is substantial turbulence in that tank due to the recirculation system that comprises the screening vessel 17, the detergent solution is thoroughly mixed before its delivery to the washing nozzles N2.

Figure 8:
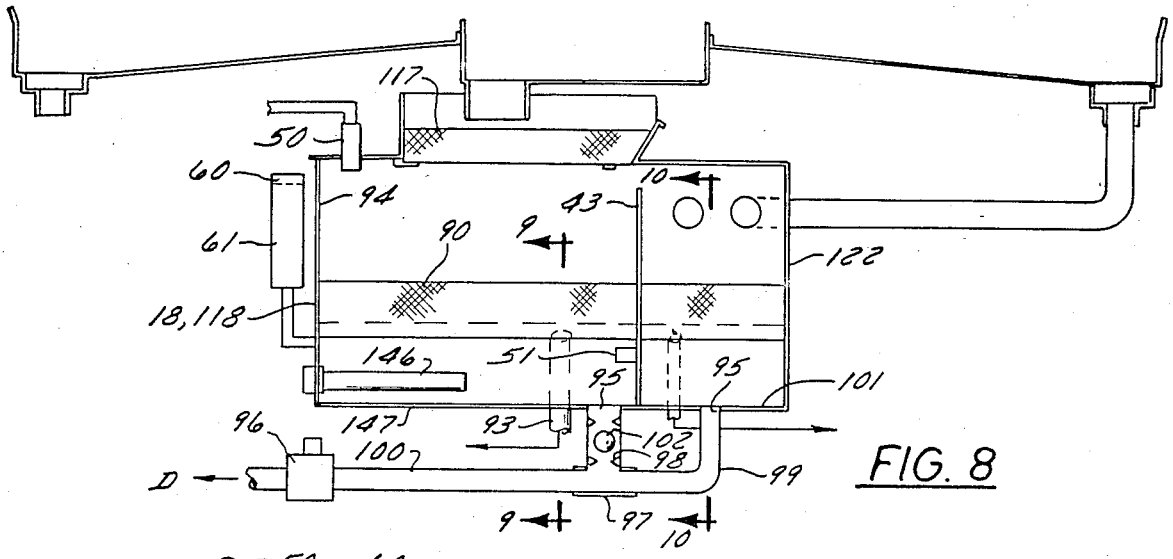
FIG. 8 is a fragmentary view in longitudinal section, generally comparable to FIG. 2, but showing a modified embodiment of the invention.
Figure 9:
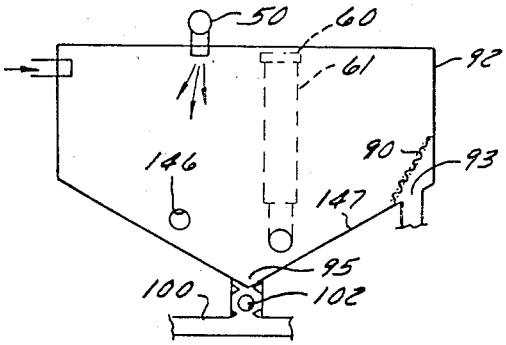
FIGS. 9 and 10 are sectional views taken on the planes of the lines 9—9 and 10—10, respectively, in FIG. 8.
Figure 10:
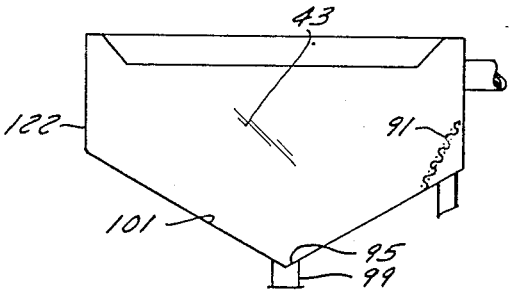

A liquid level sensor 60 associated with the detergent solution tank 18 is arranged to prevent starting of the machine before that tank is adequately filled and to shut it down when liquid in that tank falls below a predetermined critical level, as in the event of substantial blockage of the screening of the screening vessel 17. Obviously the sensor 60 could comprise a conventional float-controlled switch, but as shown in FIG. 8, and as is preferred, it comprises a pressure responsive switch mounted in the upper end portion of a standpipe 61 that has its lower end in open communication with the interior of the tank 18 near the bottom thereof. The standpipe 61 is of such height that the sensor switch 60 is well above the highest level of liquid in the tank 18 and therefore is never in contact with liquid.

It will be understood that the machine has a manually operable fill switch (not shown) for controlling energization of the solenoid valve 54 when the machine is not in operation, to provide for filling the heating tank 45 and washing liquid tank 18 prior to start-up. This fill switch is preferably so connected as to energize the detergent chemical pump 57 along with the solenoid valve 54. The liquid level sensor 60 (although not so shown in FIG. 7) preferably comprises a double-throw switch so connected with the solenoid valve 54 and the chemical pump 57 as to terminate delivery of water and detergent chemical whenever washing liquid in the tank 18 reaches substantially the filled level defined by the weir wall 43.

Sanitizing Rinse System

With preferred germicidal chemicals, the temperature of the rinsing solution can be substantially lower than that of the detergent solution, e.g., 75°-110° F. Externally heated supply water is unlikely to be below that temperature but will often be above it. For heating economy, therefore, an automatic thermostatic blender valve 62 is provided which has inlets connected with the heated water source HWS and with an unheated water source CWS and which so mixes water from those sources as to maintain at its outlet the desired rinsing liquid temperature. The outlet of the blender valve 62 is connected by means of a rinsing water duct 63 with one inlet of a mixer 64. Germicidal chemical from a reservoir 65 is delivered to the other inlet of the mixer 64 by way of a second constant-volume pump 66, such as a peristalsis pump, and a germicide duct 67 which extends between that pump and the mixer. Another duct 68 connects the outlet of the mixer with the rinsing nozzles N3.

It will be observed that rinsing liquid is delivered to the rinsing nozzles N3 under water supply system pressure. A solenoid valve 69 in the rinsing water duct 63 is energized in unison with the germicide chemical pump 66 so that water and chemical always flow to the mixing chamber 64 simultaneously, but only when the machine is in operation. There is also a flow control valve 70 in the rinsing water duct 63, for maintaining a constant-rate flow of water which, with the constant-rate delivery of germicide from the pump 66, ensures maintenance of the desired concentration of the germicidal solution.

A sensor 71 in the germicide duct 67 is so connected in the electrical control circuitry (as explained hereinafter) as to cause the machine to shut down at any time that germicidal chemical is not being delivered to the mixer 64. In accordance with the present invention the sensor 71 is located near the connection between the germicide duct 67 and the germicide chemical pump 66, and it detects the presence or absence of germicidal chemical at its location on the basis of electrical conductivity. The machine should not be shut down merely because of a bubble, or a few bubbles, in the flow of germicide chemical past the sensor 71, and its need not be shut down until absence of chemical at the sensor has persisted through a substantial period, during which chemical continues to be delivered from the relatively long portion of the germicide duct 67 that extends from the sensor 71 to the mixer 64. To accommodate this delay period, the sensor 71 is connected with the control circuitry through a time delay device TDG that has a delay period corresponding to the time required for a particle of germicide to move, under pressure of the germicide pump 66, from the location of the sensor 71 to a point in the germicide duct 67 that is near its connection with the mixer 64.

Instead of the arrangement just described, the germicide pump 64 could be turned on and off in response to the outputs of a sensor (not shown) responsive to solution concentration, monitoring the solution issuing from the outlet of the mixer 64, as in the above described arrangement comprising the detergent solution concentration sensor 59. However, a concentrationresponsive sensor can only turn on its associated chemical pump in response to a low concentration value, irrespective of whether or not chemical is available to be pumped, and therefore the above described arrangement comprising the sensor 71 is preferred. It will be apparent that the sensor 71 also eliminates the need for a sensor or gage that responds to, or indicates, the level of germicide in the reservoir 65.

In this connection it is also preferred that the detergent solution sensor 59, which is shown only by way of illustration, be replaced in practice by a sensor (not shown) that responds to the presence or absence of detergent in the detergent chemical duct 58, functioning like the above described germicide sensor 71 and similarly connected with the electrical circuitry (described hereinafter) through a time delay device TDD. The machine will thus be promptly shut down as soon as either chemical reservoir 56 or 65 is emptied.

Control of Machine Operation

A practical location for a glass washing machine is adjacent to a bar, where the machine is so arranged that its loading station is readily accessible to table service personnel and its unloading station is accessible to the bartender. When dirty glasses are present at the loading station and additional dirty glasses are to be loaded into the machine, the machine must of course be started, and to that end there is a service start switch 73 adjacent to the loading station.

Figure 7:
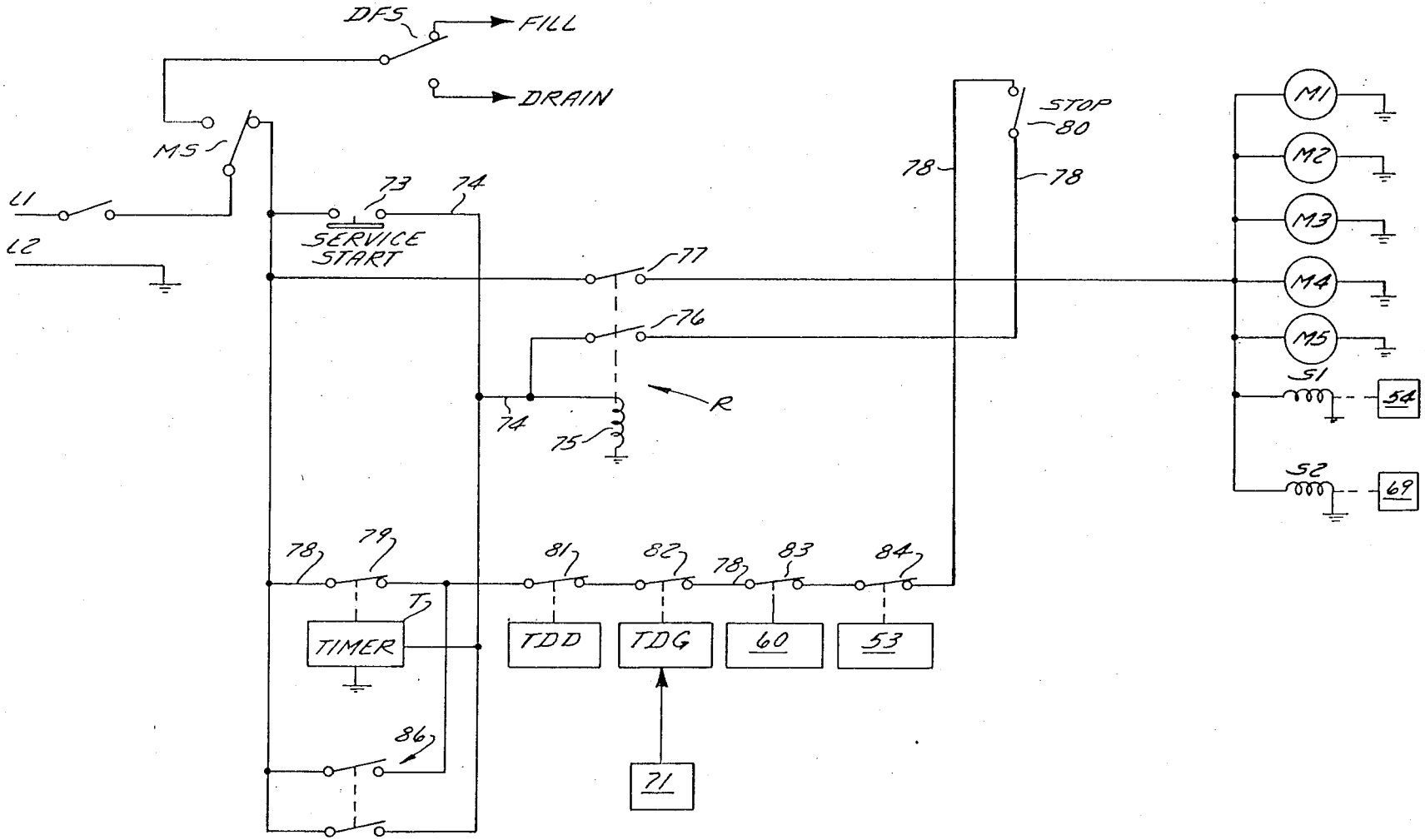
FIG. 7 is a simplified electrical circuit diagram.

As shown in FIG. 7, which is a simplified diagram of the electrical control circuitry, the start switch 73 is a normally-open momentary contact pushbutton switch connected in an energizing lead 74 for the winding 75 of a relay R that comprises two sets of normally-open contacts 76, 77. One set of contacts 76 is connected in a self-energizing lead 78 through which the current source $L_1$, $L_2$ is interruptably connected with the relay winding 75 and in which a number of normally-closed switching devices 79–84 are connected in series as described below. The other set of contacts 77 of the relay R is connected in series with the current source $L_1$, $L_2$ and with the motors M1-M5 that respectively drive the conveyor 5, the wash pump 19, the prewash pump 23 and the chemical pumps 57 and 66, as well as with the solenoids S1, S2 of the valves 54 and 69 that control infeed of supply water. Thus momentary closure of the start switch 73 energizes the relay R, closing both of its contact sets 76, 77 to energize the motors and solenoids as long as the relay remains energized, and the machine thus remains in operation until any one of the series-connected switches 79–84 in the self-energizing lead 78 is opened.

The loading station portion 6 of the conveyor 5 can accommodate only a limited number of glasses, and it is not economical to run only these few through the whole sanitizing cycle. The service start switch 73 is therefore connected with a timer mechanism T which controls a switching device 79 that is one of the several in the self-energizing lead 78. After a predetermined interval (e.g., 45 seconds) following actuation of the start switch 73, the timer T opens the switching device 79, energization of the relay R is terminated, its contacts open, and operation of the machine is stopped. This operating interval is long enough for the conveyor 5 to carry all dirty glasses at the loading station into the tunnel and thus make room for a new batch of dirty glasses at the loading station. After a few batches of dirty glasses have been brought to the loading station, and the machine has been started for each such batch, this intermittent mode of operation ensures that the machine always runs with substantially a full capacity load, for optimally economical utilization of water, chemicals and current.

When glasses arrive at the unloading station 8, glasses behind them on the loaded conveyor are of course unable to advance, and therefore the machine is stopped even if a time interval controlled by the timer mechanism T has not expired. Such shutdown is effected by a normally-closed limit switch 80 in the self-energizing lead 78, comprising a microswitch having a bar-like actuator 85 at the front end of the unloading station, extending across the entire width of the conveyor. Forwardly moving glasses engage this actuator 85 and shift it forwardly against a light bias on it, to bring the microswitch to its open condition. Preferably the limit switch 80 is so connected with the timer mechanism T that opening of the limit switch resets the timer. Thus upon removal of glasses from the unloading station, the machine can be restarted by actuation of the start switch 73 and will continue to run until the full timed interval has elapsed or the limit switch 80 is again opened, whichever occurs first.

The other normally closed switch devices 81–84 that are connected in series with one another in the self-energizing lead 78 are respectively controlled by the chemical feed sensors through their respective time delay devices TDD and TDG, the sensor 60 that responds to a critically low level of detergent solution in the washing liquid tank 18, and the thermostatic switch 53 in the washing liquid tank, any one of which can cause the machine to shut down in response to an abnormal condition, as explained above. Obviously any or all of these sensors could be connected with pilot lights (not shown) or other devices that would designate the cause of shutdown. However, in some cases it may be desirable not to provide such diagnostic indications, so that in the event of a shutdown all of the relatively few possible causes for it will have to be checked. In the course of such a check, which can be performed rather quickly, any incipient cause of a subsequent shutdown is likely to be found and corrected, so that shutdowns for abnormal conditions will tend to be infrequent.

At the end of the business day all glasses then on the conveyor should be completely cleansed, whether or not they constitute a full load. at that time it would be inconvenient to have to actuate the start switch 73 repeatedly, and therefore a special starting switch 86 is mounted adjacent to the unloading station, preferably arranged to be closed by moving the bar-like actuator 85 rearwardly from a neutral position to which it is biased. The special starting switch 86 can be a double-pole single-throw switch having one set of contacts connected in parallel with the service start switch 73. The other set of contacts of the special start switch 86 is connected in paralle with the switch element 79 that is controlled by the timer mechanism T, but in series with the other switch elements 80–84 in the self-energizing lead 78, so that as long as the special start switch remains in its closed condition the machine will continue to run except as it is stopped by opening of the unloading zone limit switch 80 or any of the switch devices 81–84 that respond to abnormal conditions.

The machine also has a manually operable mode switch MS that has one condition (in which it is shown in FIG. 7) for normal operation of the machine and another condition in which it is placed for routine maintenance. With the mode switch MS in its maintenance condition, another double-throw switch DFS connected in series with it provides, alternatively, for drainage of the retention tanks 18 and 22 so that they can be cleaned, or for filling of those tanks in preparation for startup. The circuitry associated with the mode switch MS and the drain-fill switch DFS is not shown since it comprises solenoid valves connected in a manner that will be obvious to those skilled in the art.

Modified Embodiment

In the modified form of the invention illustrated in Figs. 8–11 the conveyor tunnel, nozzle sets and liquid collection pan are arranged as described above and therefore are not shown; and the recirculation scheme is also generally like that described above. The washing liquid tank 118 and the prewash liquid tank 122 are again arranged side-by-side, separated by a common wall 43 that serves as a weir across which detergent solution can flow into the prewash liquid tank. In other respects the modified embodiment is also like that described above, except as pointed out hereinafter.

In this case there is no water heating tank. Instead, water from the source, preferably preheated to some extent before it enters the machine, is fed directly into the washing liquid tank 118, which has a shallow V-shaped or U-shaped bottom wall. A high capacity immersion heater 146 is mounted in that tank, near the lowest part of its bottom, and is controlled by the thermostatic switch 51 in that tank.

Detergent solution discharged from the washing nozzles N2 is directed into a screening vessel 117 that is readily removably supported on the supper portion of the washing liquid tank 118. Normally the washing liquid entering that vessel falls through its bottom screen portion into the washing liquid tank, but upon substantial blockage of its screen, the overflow from it is directed into the prewash liquid tank 122.

Although most of the foreign matter that could clog the nozzle N1, N2 is collected in the screening vessel 117, some amount of such material can be present in the liquid in one or both of the retention tanks 118 and 122. However, an inclined fine-mesh screen 90 in the washing liquid tank 118 and a similar screen 91 in the prewash liquid tank 122 prevent all such material from passing out of those tanks with the liquids withdrawn from them by the wash pump 19 and the prewash pump 23, respectively. Since the arrangement of the inclined screen 91 in the prewash liquid tank is in essentials identical to that of the angled screen 90 in the washing liquid tank, a description of the latter will be sufficient to cover both.

The cabinet (no shown) for the machine has an opening in one side thereof through which the retention tanks 118 and 122 are accessible for cleaning, and of the upright walls of the washing liquid tank, the most readily accessible one is the side wall 92 opposite that opening. The recirculation outlet 93 through which detergent solution is drawn out of the washing liquid tank 118 to the wash pump 19 is near the corner junction between that accessible side wall 92 and the bottom wall 147 of the tank, and preferably in the bottom wall 147.

The inclined screen 90 extends across that corner and over the recirculation outlet 93. It is preferably a flat sheet of light gage stainless steel in which there are numerous small perforations. It extends the full length of the washing liquid tank 118. Its upper edge is secured along its length to the side wall 92 at a substantial distance above the bottom wall 147, and its bottom edge is secured along its length to the bottom wall 147, at a substantial distance inwardly from the side wall 92. The end edges of the inclined screen 90 are similarly secured to the end walls 43, 94 of the tank 118, so that liquid in the tank 118 must pass through that screen to reach the recirculation outlet 93.

The screen 90 is inclined to the horizontal at an angle of at least 45°, and preferably of 60° to 70°, so that it is to some extent self-cleaning because particles that are caught by it tend to move down it towards the bottom of the washing liquid tank, impelled both by their own weight and by the generally downward flow of liquid towards the recirculation outlet 93. Because of its large area, the screen 90 is unlikely to be clogged to such an extent that it materially blocks flow of liquid to the wash pump 19. Moreover, the inclined screen tends to be kept clean by a backflushing that occurs after each period of operation of the wash pump 19, owing to that pump being a centrifugal one. When that pump stops, liquid drains back through it from the washing nozzles N2, passing inwardly through the inclined screen 90 as it returns to the washing liquid tank 118, and flushing off of that screen any particles that lodged against it during the preceding period of pump operation. It will be understood that the inclined screen 91 in the prewash liquid tank 122 is subjected to similar backwashing because the prewash pump 23 is a centrifugal one.

For regular maintenance of the machine with inclined screens 90, 91, the washing liquid tank 118 and the prewash tank 122 are drained and are simply hosed with water, with particular attention to flushing down all foreign matter collected on their inclined screens. Here again, the inclination of the screen facilitates cleaning because foreign matter tends to wash down along it to the bottom of the tank, to be readily flushed towards a waste drain outlet 95 in the lowest part of the bottom wall, at the opposite side of the inclined screen from the recirculation outlet 93. No more than plain-water rinsing of the tanks 118 and 122 is normally necessary, since both are bathed in detergent solution at all times that the machine is in operation and thus have no tendency to collect dirt other than bits of foreign matter.

Instead of providing an individual plug or valve for each waste drain outlet 95, draining of the two retention tanks 118 and 122 is controlled by means of a single normally closed solenoid valve 96. Beneath the retention tanks 118 and 122 there is a function fitting 97 to which a branch duct 98 leads downward from the drain outlet 95 in the washing liquid tank 118 and to which another branch duct 99 leads downward from the drain outlet in the prewash tank 122. The solenoid valve 96 is in a drain duct 100 that leads from the junction fitting 97 to the waste drain D. In the branch duct 95 that leads down from the washing liquid tank 118 to the junction fitting 97 there is a floating ball check valve 102 which permits flow from that tank towards the junction fitting but blocks upward flow into the washing liquid tank. Thus, when the level of liquid in the washing liquid tank 118 is higher than that in the prewash tank 122, the buoyant check valve 102 is forced off of its seat by flow of liquid from the washing liquid tank to the drain if the solenoid valve 96 is open or to the prewash tank 122 if the solenoid valve is closed; whereas the buoyant check valve remains closed whenever the liquid in the prewash tank is higher than that in the washing liquid tank, to prevent any mixing of prewash liquid with the detergent solution. The inexpensive check valve 102 thus eliminates the need for an additional solenoid valve and the control circuitry for it, simplifying the electrical circuitry and the maintenance procedure as well as decreasing the cost of the machine.

From the foregoing explanation taken with the accompanying drawings, it will be apparent that this invention provides a very efficient glass washing machine for taverns and restaurants that shuts itself off when it cannot assuredly bring dirty glasses to total cleanliness and germ-free sterility but nevertheless operates reliably with a minimum of attention and maintenance and with optimum efficiency in its utilization of water, chemicals and electric current.

What is claimed as the invention is:

1. A machine for washing articles such as beverage glasses, comprising a plurality of spray nozzles arranged in sets, conveyor means for carrying articles to be washed along a defined path, from a loading station successively through a washing zone having a set of washing nozzles from which washing liquid is discharged against the articles and a rinsing zone having a set of rinsing nozzles from which rinsing liquid is discharged against the articles, to an unloading station, means for delivering washing liquid under pressure to said set of washing nozzles, means for delivering rinsing liquid under pressure to said set of rinsing nozzles, a retention tank, and means for conducting into said retention tank a substantial portion of the rinsing liquid discharged from said set of rinsing nozzles, said machine being characterized by:

A. A set of prewash nozzles along said path, in a prewash zone between said loading station and said washing zone;

B. means comprising a prewash pump for withdrawing liquid from said retention tank and delivering it under pressure exclusively to said set of prewash nozzles for discharge from them against articles on said conveyor, to prewash the articles prior to their being sprayed with washing liquid;

(C. a washing liquid tank at a level below said set of washing nozzles and having a recirculation outlet near its bottom;

D. return means for collecting substantially all washing liquid discharged from said set of washing nozzles and directing it towards said washing liquid tank;

E. a wash pump communicated only with said recirculation outlet and with nozzles of said set of washing nozzles, for withdrawing washing liquid through said recirculation outlet and delivering it under pressure to those nozzles for discharge from them;

F. means for introducing makeup washing liquid from a source thereof into said washing liquid tank;

G. means providing for one-way communication between said tanks, permitting flow into the retention tank from the washing liquid tank whenever liquid in the latter tends to rise above a predetermined filled level but at all times preventing opposite flow; and H. said source of washing liquid comprising:

(1) a heating tank below said washing liquid tank, having (a) a top wall which serves as the bottom wall of the washing liquid tank to provide for heat transfer between contents of those tanks, (b) an inlet connectable with a source of water, and (c) an outlet communicated with the interior of the washing liquid tank; and (2) an electric heating element in said heating tank.

2. A machine for washing articles such as beverage glasses, comprising a plurality of spray nozzles arranged in sets, conveyor means for carrying articles to be washed along a defined path, from a load station successively through a washing zone having a set of washing nozzles from which washing liquid is discharged against the articles and a rinsing zone having a set of rinsing nozzles from which rinsing liquid is discharged against the articles, to an unloading station, means for delivering washing liquid under pressure to said set of washing nozzles, means for delivering rinsing liquid under pressure to said set of rinsing nozzles, a retention tank, and means for conducting into said retention tank a substantial portion of the rinsing liquid discharged from said set of rinsing nozzles, said machine being characterized by:

A. a set of prewash nozzles along said path, in a prewash zone between said loading station and said washing zone;

B. means comprising a prewash pump for withdrawing liquid from said retention tank and delivering it under pressure exclusively to said set of prewash nozzles for discharge from them against articles on said conveyor, to prewash the articles prior to their being sprayed with washing liquid, C. a washing liquid tank at a level below said set of washing nozzles and having a recirculation outlet near its bottom;

D. return means for collecting substantially all washing liquid discharged from said set of washing nozzles and directing it towards said washing liquid tank;

E. a wash pump communicated only with said recirculation outlet and with nozzles of aid set of washing nozzles, for withdrawing washing liquid through said recirculation outlet and delivering it under pressure to those nozzles for discharge from them;

F. means for introducing makeup washing liquid from a source thereof into said washing liquid tank;

G. means providing for one-way communication between said tanks, permitting flow into the retention tank from the washing liquid tank whenever liquid in the latter tends to rise above a predetermined filled level but at all times preventing opposite flow; and H. a screening vessel which is substantially above the bottom of said washing liquid tank and into which said return means discharges, said screening vessel having (1) a lower portion of fine mesh screen material through which liquid received in the screening vessel normally falls into the washing liquid tank, and (2) an overflow outlet, (a) which is at an overflow level above said lower portion, (b) through which liquid flows out of the screening vessel whenever liquid therein tends to rise above said overflow level, and (c) which is arranged for discharge into said retention tank.

3. The machine of claim 1, further characterized by:

(1) a second electric heating element in said washing liquid tank; and (2) thermostatic switch means in said washing liquid tank, responsive to the temperature of contents of that tank and connected with said second electric heating element for maintaining the same connected with a current source while said temperature is below a predetermined value and disconnected from that source when said temperature is above that value.

4. The machine of claim 2, further characterized by:

means for collecting all of the liquid discharged from said set of prewash nozzles and conducting it away from the machine.

5. The machine of claim 2 wherein said conveyor means, said prewash pump and said wash pump have electrically energizable drive means, further characterized by:

control switch means responsive to the level of liquid in said washing liquid tank, connected with said drive means and arranged to turn off said drive means when liquid in the washing liquid tank falls below a predetermined critical level which is substantially lower than said filled level.

6. The machine of claim 2 wherein said means providing for one-way communication comprises an outlet from said washing liquid tank that is at said filled level and opens into said retention tank, further characterized by:

said retention tank having an overflow outlet therein which is at a level substantially above its bottom but below said filled level and which opens to a drain whereby liquid is conducted away from the machine.

7. The machine of claim 6 wherein said washing liquid tank and said retention tank have an upright wall in common that has an upper edge portion which is at said filled level to provide said outlet from the washing liquid tank.

8. A machine for washing articles such as beverage glasses, said machine being connectable with a source of water and with a source of electric current and comprising nozzle means from which cleansing liquid comprising heated water is discharged against articles to be cleaned, diversion means for conducting away from the machine a portion of the cleansing liquid discharged from said nozzle means, a recirculation system comprising a holding tank for temporarily storing the remainder of the cleansing liquid discharged from said nozzle means and means comprising a pump for withdrawing cleansing liquid from said holding tank and delivering it under pressure to said nozzle means, and means for delivering makeup cleansing liquid to said recirculation system at a rate to normally maintain a substantially constant level of cleansing liquid in said holding tank, said machine being characterized by:

A. a water heating tank having an inlet connectable with said source of water and an outlet communicated with said recirculation system, said water heating tank (1) being mounted below said holding tank and (2) having a top wall which also serves as a bottom wall for the holding tank so that said wall provides for heat transfer between the contents of those tanks;

B. a first electric heating element in the interior of said water heating tank, disposed to be immersed in the contents thereof;

C. a second electric heating element in the interior of said holding tank, disposed to be immersed in the contents thereof; and D. thermostatic switch means responsive to the temperature of the contents of said holding tank and arranged to maintain a connection between said second electric heating element and said electric current source while said temperature is below a predetermined value and to open said connection when said temperature attains said value.

9. A machine for washing articles such as beverage glasses, said machine having moving parts operated by electrically energizable drive means and comprising nozzle means from which a cleansing liquid is normally discharged at a substantially constant discharge rate, and recirculation means comprising a pump for delivering said cleansing liquid under pressure to said nozzle means and a retention tank which is at a level below said nozzle means to receive cleansing liquid discharged from said nozzle means and which has a bottom portion from which said pump withdraws cleansing liquid, said machine being characterized by:

A. a screening vessel at a level above said bottom portion of the retention tank and below the level of said nozzle means, arranged to receive substantially all of said cleansing liquid that is discharged from said nozzle means, said screening vessel having
  (1) a lower portion of fine mesh screen material through which cleansing liquid normally passes into said retention tank, and
  (2) an overflow outlet
    (a) which is at an overflow level spaced above said lower portion,
    (b) through which liquid flows out of said screening vessel when liquid therein tends to rise above said overflow level, and
    (c) which is communicated with a drain and so arranged as to direct liquid flowing therethrough away from said retention tank; and B. switch means responsive to the level of liquid in said retention tank, said switch means
  (1) being connected with said driven means and connectable with a source of electric current for energizing the drive means and
  (2) being arranged for maintaining said drive means connected with said current source so long as liquid in the retention tank is above a predetermined critical level and for disconnecting the drive means from said current source when that liquid falls below said critical level.

10. The machine of claim 9 wherein said moving parts include a conveyor on which articles to be washed are carried in one direction and wherein said nozzle means comprises a set of washing nozzles from which said cleansing liquid is discharged as a washing liquid, further characterized by:
  (1) a set of rinsing nozzles spaced in said direction from said set of washing nozzles and from which a rinsing liquid is discharged;
  (2) a second tank arranged to receive rinsing liquid discharged from said set of rinsing nozzles;
  (3) a set of prewash nozzles spaced in the opposite direction from said set of washing nozzles; and
  (4) means comprising a second pump for withdrawing liquid from said second tank and delivering it under pressure to said set of prewash nozzles for discharge therefrom.

11. The machine of claim 10, further characterized by:
  makeup means for delivering cleansing liquid to said recirculation means at a makeup rate substantially lower than said discharge rate.

12. The machine of claim 11, further characterized by: means providing for overflow communication between said retention tank and said second tank, for allowing liquid to flow from the former to the latter as necessary to prevent liquid in the retention tank from rising above a predetermined filled level which is substantially above said critical level.

13. The machine of claim 12 wherein said second tank has an overflow drain outlet through which liquid can flow away from the machine and which is at a level below said filled level but substantially above said critical level, further characterized in that said means providing for overflow communication between said retention tank and said second tank comprises:
  an upright wall common to both of said tanks and having an upper edge which has its lowest portion at said filled level.

14. The machine of claim 12 wherein said second tank has an overflow drain outlet through which liquid can flow away from the machine and which is at a level below said filled level but substantially above said critical level, further characterized in that said means providing for overflow communication between said retention tank and said second tank comprises:
  (1) a manifolding connector at a level below the bottoms of both of said tanks;
  (2) a first branch duct extending to said manifolding connector from a manifolding outlet in the bottom of said second tank;
  (3) a second branch duct extending downward to said manifolding connector from a manifolding outlet in the bottom of said retention tank to provide for communication between the two tanks through said manifolding connector; and
  (4) a check valve in said second branch duct having a buoyant valve element and which is closed by buoyant force on said valve element when liquid in said second tank is above the level of liquid in said retention tank.

15. The machine of claim 14, further characterized by:
  (5) a drain duct connected with said manifolding connector to be communicated therethrough with both of said branch ducts; and
  (6) a valve in said drain duct that can be opened for draining both of said tanks.

16. The machine of claim 11 wherein said makeup means comprises:
  (1) a heating tank having
    (a) an inlet communicable with a source of water,
    (b) an outlet, and
    (c) a top wall which also serves as a bottom wall for said retention tank and which is thus in heat exchange relationship with the contents of those tanks;
  (2) an electric heating element in said heating tank;
  (3) means comprising a duct and a flow control valve for delivering water at a predetermined rate from said outlet of the heating tank to said retention tank; and
  (4) means for delivering a washing chemical from a source thereof to said retention tank at a predetermined rate and in unison with delivery of water from said heating tank to said retention tank.

17. A machine for washing articles such as beverage glasses, comprising a plurality of spray nozzles arranged in sets and a conveyor for carrying articles to be washed along a defined path from a loading station to an unloading station through a succession of zones for each of which there is one of said sets of nozzles and in each of which a liquid is discharged against the articles from the set of nozzles for the zone, said machine being characterized by:

A. a pair of tanks mounted beneath said nozzles,
  (1) one of said tanks being a washing liquid tank,
  (2) the other being a prewash liquid tank having, at an overflow level above the bottom thereof, an overflow outlet communicable with a waste drain, and (3) each of said tanks having a recirculation outlet near the bottom thereof;

B. means providing for one-way communication between said tanks whereby flow from the prewash liquid tank to the washing liquid tank is at all times prevented but opposite flow is permitted as necessary to prevent liquid in the washing liquid tank from rising above a predetermined filled level which is at least as high as said overflow level;

C. first recirculation means comprising a prewash pump communicated with the recirculation outlet in said prewash liquid tank and with the set of nozzles for a first of said zones, for delivering liquid from that tank to that set of nozzles for discharge therefrom;

D. first liquid collection means underlying said set of nozzles for the first zone and arranged for collecting substantially all liquid discharged from those nozzles and directing it to said waste drain;

E. makeup means for filling washing liquid into said washing liquid tank at a makeup rate;

F. second recirculation means comprising a wash pump communicated with the recirculation outlet in the washing liquid tank and with the set of nozzles for a second of said zones, for delivering liquid from that tank to that set of nozzles for discharge therefrom at a rate which is normally substantially higher than said makeup rate;

G. second liquid collection means underlying the set of nozzles for said second zone, for collecting substantially all liquid discharged from those nozzles and directing at least a major portion thereof into said washing liquid tank;

H. rinsing liquid delivery means for delivering rinsing liquid to the set of nozzles for a third of said zones for discharge therefrom; and I. third liquid collection means underlying the set of nozzles for said third zone, for collecting all of the liquid discharged from those nozzles and directing at least a major portion thereof into said prewash liquid tank.

18. The machine of claim 17, further characterized in that said means providing for one-way communication between said tanks comprises an upright wall which is common to those tanks and which has an upper edge, the lowest portion of which is at said filled level and is above said overflow level.

19. The machine of claim 17 wherein each of said tanks has a bottom wall and has a pair of opposite side walls and a pair of opposite end walls which project up from that bottom wall, further characterized by:

(1) said recirculation outlet in each said tank being near the junction of its bottom wall with one of its side walls; and (2) each said tank having therein a fine-mesh screen which is inclined to the vertical and which extends across its recirculation outlet, said screen having (a) an upper edge which is engaged along its length against said one side wall at a level above said bottom wall, (b) a lower edge which is engaged against said bottom wall in inwardly spaced relation to said side wall, and (c) opposite end edges, each of which is engaged along its length against one of said end walls, so that all liquid leaving the tank through its recirculation outlet must pass through said screen.

20. The machine of claim 19, further characterized in that each of said pumps is a centrifugal pump.

* * * * *